United States Patent [19]

Gianfranco

[11] Patent Number: 4,770,752

[45] Date of Patent: Sep. 13, 1988

[54] PROCESS FOR PURIFYING THE GASES EMITTED FROM THE ELECTROLYSIS POTS FOR THE PRODUCTION OF ALUMINUM AND RELATED EQUIPMENT

[75] Inventor: Zannini Gianfranco, Limena, Italy

[73] Assignee: Techmo Car S.p.A., Limena, Italy

[21] Appl. No.: 45,548

[22] Filed: May 4, 1987

[30] Foreign Application Priority Data

Jul. 15, 1986 [IT] Italy ..... 21123 A/86

[51] Int. Cl.[4] ..... C25C 3/06

[52] U.S. Cl. ..... 204/67; 204/247

[58] Field of Search ..... 204/243 R, 67, 245, 204/247, 246

[56] References Cited

U.S. PATENT DOCUMENTS

| | | | |
|---|---|---|---|
| 3,681,229 | 8/1972 | Lowe | 204/246 |
| 4,008,135 | 8/1986 | Brown | 204/67 |
| 4,049,529 | 9/1977 | Golla | 204/246 |
| 4,176,019 | 11/1979 | Dethloff | 204/247 |
| 4,321,115 | 3/1982 | Rebman et al. | 204/245 |
| 4,563,255 | 1/1986 | Heinzmann et al. | 204/67 |

*Primary Examiner*—R. L. Andrews

*Attorney, Agent, or Firm*—Collard, Roe & Galgano

[57] ABSTRACT

Process for purifying the fumes emitted by electrolysis pots for the production of aluminum from fluorinated products, alumina and various components of the electrolysis bath, and for using again these products in the pots. The process consists in sucking the electrolysis fumes from at least a hole provided in the crust, and kept constantly open, by keeping under suction only the area surrounding said hole, in contacting the fumes with alumina, and in reintroducing the products fixed and/or retained on the alumina directly back into the same pot from which they have been emitted. Equipment for accomplishing the process, constitutes a cap placed in contact with the crust in correspondence of the hole, by a reactor of the fluidized bed type, or of the injection "Venturi" type, positioned in correspondence of the pot, with related filter and fan/exhauster.

6 Claims, 2 Drawing Sheets

PROCESS FOR PURIFYING THE GASES EMITTED FROM THE ELECTROLYSIS POTS FOR THE PRODUCTION OF ALUMINUM AND RELATED EQUIPMENT

The object of the present invention is a process for purifying the gases or fumes emitted from electrolysis pots for the production of primary aluminum, directly at the outlet from the same pots, directly recycling back into the pot, in single cycle, the substances recovered from the fumes.

Also an object of the present invention is the provisions of equipment for carrying out the purification of the gases emitted from the electrolysis pots, by dry-system over alumina.

It is known that the primary aluminum is produced by electrolysis of alumina ($Al_2O_3$) dissolved in a molten bath of sodium fluoaluminate of composition substantially corresponding to $Na_3ALF_6$ at therefore temperature of about 950° C. The electrolysis cells or pots constitute a steel shell, lined with blocks and/or rammed linings of carbonaceous material, the bottom of which acts as the cathode, on which the metal aluminum settles and is collected in the molten state. The anode, which constitutes a carbonaceous material, and can be of the Soederberg type, or of the multiple-prebaked-elements type, is installed on the upper side of the cell. Oxygen evolves which, on contacting the anode carbon at the electrolysis temperature, is converted into carbon dioxide ($CO_2$) according to the global reaction:

$$2\ Al_2O_3 + 3\ C = 4\ Al + 3\ CO_2$$

This amount of carbon dioxide is actually doubled, as known, due to the processes of reoxidizing of the aluminum, of direct reaction of carbon with the atmospheric oxygen, and the like.

Carbon dioxide is emitted in the gas state on the surface and escapes from the molten bath, saturated with fluoride vapours at 950° C. and furthermore it mechanically drags droplets and solid particles of fluorides which can also be ultrafine in size, in particular when derived from the condensation of vapours, and hence in aerosol form, hydrogen fluoride gas deriving from the reaction of hydrogen-containing pitch-like compounds with the molten fluorides in the bath; as well as entrained aluminum oxide particles, carbon dusts and several carbonaceous substances and the like.

In a modern medium-sized pot, such as one of 150 kA with pre-baked anodes, by which on the average from 40 to 45 kg per hour of aluminum is produced, the formation and evolving occurs of about 40 $Nm^3/h$ of $CO_2$, equivalent to about 180 $m^3/h$ at a temperature of 950° C. (respectively corresponding to 0.9–1 $Nm^3$ and to 4–4.5 $m^3$ per kg of produced aluminum). In a potroom containing 100 electrolysis cells of this type, the amount of $CO_2$ which is evolved from the pots over 1 hour at the operating temperature is therefore of about 18,000 $m^3$.

As previously mentioned, $CO_2$ escaping from the pots is accompanied by large amounts of fluorinated products and of such other products as alumina, coal and the like, which all are highly polluting and must hence be removed from the electrolysis fumes before flowing into the working premises and into the atmosphere. For most of them, it is furthermore a matter of products constituting the electrolysis bath, the escape of which from the same bath represents either directly or indirectly a loss of material, which has then to be replaced.

On the average, the emission from the electrolysis pots of $CO_2$-accompanying products, both as hydrogen fluoride outcoming from the thermal hydrolysis reactions, and as vapours, and/or droplets and/or mechanically dragged particles, is comprised in the overall within the range of from 50 to 150 g per kg of aluminum produced and has a fluorine content ranging from 10% to 50%, so that the emission of fluorinated products, as expressed as F, is comprised in the average between 10 and 30 g of F per kg of produced aluminum.

Processes and related plants are already known for purifying the electrolysis fumes from the products accompanying them, and allowing said products to be recovered and to be used again in the electrolysis pots. Said processes consist substantially in sucking the electrolysis fumes which evolve from the surface of the molten bath, and which escape through the cracks of the "crust" constituted by solidified bath which covers the same bath, in conveying said fumes together with the vapours, the droplets and the solid particles accompanying them, outside the pot area, and in subsequently submitting them to a purification treatment, which can be either of the wet type, of scrubbing by water, or of the dry type over alumina.

The wet-type treatment consists in scrubbing the conveyed fumes with water recycled several times, and in subsequently precipitating the fluorides from the so-obtained solution, together with the solid particles of fluorides and of other suspended matter, by the addition of sodium hydroxide. The fluorides, filtered off and dried, are then used again in the electrolysis pots for the preparation of the bath.

The dry-type treatment, as known, consists in having the gases sucked from the electrolysis cells, pass through a fluidized bed of aluminum oxide, on which aluminum oxide the hydrogen fluoride is fixed by surface adsorption. The gases, after leaving the fluidized bed, pass through a series of cyclones and filters and are then discharged to the atmosphere, while alumina which has fixed hydrogen fluoride, together with the other various substances and constitutents coming from the bath, is retained by the cyclones and the filters and is collected inside suitable centralized silos and is then distributed from these, by a suitable conveyance and distribution system, into the electrolysis pots, the removal of the polluting products from the gases to be discharged to the atmosphere, as well as the recovery and re-use of the fluorides dragged by the electrolysis fumes being thus achieved.

For purpose of allowing the suction of the electrolysis fumes, and then conveying them to the purification equipment, the pots are "closed" by a "hood", which covers the anodic area and the pot free surface comprising the solidified crust, said hood being connected, by a hood-connecting and uniting pipe system, to the suction and purification equipment which, owing to its size and complexity, is usually installed outside the potroom. Different types exist of hoods which, while securing a good coverage of the pot, must be at the same time openable and easily demountable to allow such various working operations as crust breaking to feed alumina, crust breaking for tapping of molten metal, anode change, and so forth, to be carried out on the pot. On the pots equipped with hood, the operations of crust breaking and alumina feeding are carried out most of times inside the same hood, without either opening or removing it, by so-denominated "wedge", "comb" or "point" beating means, stably associated to the pot structures. Such devices, respectively consisting in one or more "combs" or "rakes" of various shapes, or in a set of points, are sunk at regular time intervals according to a preestablished program, e.g., every 15 or 30 minutes, onto the solidified crust on the free surface of the pot, breaking it and thus allowing the alumina deposited on the same crust during the heating and prefeeding step, to fall down into the molted bath, and to dissolve in it.

Also known are types of hoods which cover only a portion of the free surface of the electrolysis pot, positioned, e.g., in correspondence of "breathers" on the crust, as in case of Soederberg pots, or nearby in correspondence of the beating and alumina feeding devices.

But in practice these techniques, even if they show the advantage of yielding a rather high efficiency of sequestering and recovery of polluting elements, show a number of drawbacks and limitations, which can be summarized as follows:

The system of collecting and conveying the gases to a centralized purification plant involves the installation of fixed large-diameter pipes which, starting from each pot, pass through the potroom up to the purification plant, constituting an element of considerable overall dimensions and of very high cost. Furthermore, such a piping system and the room to contain it must be provided for when designing the whole electrolysis plant; on already existing electrolysis plants, wherein the purification of the fumes had not been initially taken into consideration, it can be installed only with much difficulty and consequent extremely high costs.

The conveyance of the fumes through a system of long and tortuous pipes involves overcoming high pressure drops and hence requires the use of high power exhausters, of very high cost.

It is known that in case of dry-purification of the fumes conveyed from the electrolysis pots, use is made of the same alumina which must be fed to the pots, it being previously passed through the purification step, wherein fluorine, both as hydrogen fluoride and as fluorides, is retained on the same alumina, together with the other constituents of the electrolysis bath, which are also dragged by the fumes. As already said, such alumina leaving the purification equipment is collected inside suitable silos and from these distributed to the electrolysis pots, but without it being possible its fluorine content to be accounted for, and hence the actual requirement for this element by each individual pot to be evaluated.

The conveyance of the gases along long pipe stretches before arriving at the purification equipment causes a considerable drop in their temperature. As a consequence, the contact with alumina takes place at relatively low temperature, so that, as known, a portion of hydrogen fluoride is fixed in a labile way and furthermore with an uneven distribution on the surface of the particles of alumina.

In particular in case of hoods covering the whole pot surface, the volume of intaken fumes to be processed on purification equipment is very large relative to the volume of fumes evolved in the electrolysis process and, as a consequence, both the fumes conveyance system and purification plants result in large dimensions and very high cost. In fact, together with the real electrolysis gas, substantially constituted by $CO_2$ which evolves from the molten bath, and escapes through the solidified crust, according to the processes of the known art, it is necessary to convey to the purification plants also the considerably large amounts of air which are intaken through the leaks and the openings of the traditional so as to remove and dispose of the heat emitted by the pot surface enclosed by the hood. It is known that, to the purpose of ensuring a high enough efficiency of sequestering, and of preventing part of the fumes from escaping to the outside through the leaks and the openings unavoidably present in all hood closing systems and flowing into the working premises and to the atmosphere, the air expansion due to the heat emission by the pot surface must be such that the pressure inside the hood is always lower than outside pressure. It is known that, to avoid gas leaks from the hood, the following equation must be complied with:

$$P \geqq \frac{d \cdot Q}{c \cdot g}$$

wherein P is the minimum flow rate of the fumes to be removed, as referred to the amount of aluminum produced, d is the air expansion coefficient, Q is the amount of heat emitted by the surface of the pot, as referred to the amount of aluminum produced, c is the air specific heat and g is its specific gravity. It can be seen how the hood suction flow rate is basically determined by the amount of heat dispersed inside it, i.e., by the surface of pot covered by the same hood. With 150-kA prebaked-anode pots, the gas volume to be intaken from a closed hood of known type is of the order of 150–100 $Nm^3$ per kg of aluminum produced, as compared to the 0.9–1 $Nm^3$ of $CO_2$, actually produced, and which should be removed, as a consequence of the electrolysis process. Owing to the large amount of air which is intaken together with the electrolysis fumes, the concentration of substances contained inside conveyed gases in decreased and consequently reduced efficiencies of removal and purification. Furthermore, owing to the high dilution rate of fumes with air, the temperature of fumes leaving a total-cover hood of known type, according to the processes of the known art, are still lower.

Purpose of the present invention is to provide a process for purifying the fumes evolving from the electrolysis pots for aluminum production with high efficiencies of removal of polluting elements as vapours, droplets and dusts, capable of overcoming the drawbacks and limitations of the purification systems used to date, and in particular of the so-denominated dry-processes, on fluidized-bed alumina.

Another purpose of the invention is to provide a recovery and re-use of the substances emitted from the pots during the electrolysis, without altering the balance of materials inside the same pot, in particular as regards the fluorinated products and/or possible particular additives.

A further purpose of the invention is to provide an equipment installable of nearby of each electrolysis pot, of simple and reliable structure, and of limited size and cost, so as to allow the processing for purification of the electrolysis fumes and recovery and recycle of the products entrained by said fumes to be accomplished as one single cycle and directly on the same pot they come from.

Still another purpose is to provide equipment which can be, easily and with limited cost, on already existing electrolysis pots installed, in which the purification of the electrolysis fumes had not been preliminarily taken into account.

Still a further purpose of the invention is to provide a process for purifying the electrolysis fumes by a dry-process over alumina, by stably and uniformly fixing hydrogen fluoride on the alumina.

These purposes and related advantages, together with still others which may become clear from the following disclosure, are achieved by a process for purifying the electrolysis fumes emitted from the pots for the production of aluminum from fluorinated products, alumina, various constituents of the electrolysis bath, as entrained vapours and/or solid and/or liquid particles and to recover and reuse said products and said constituents in said pots, which process consists, according to the present invention, in providing at least one hole in the solidified crust of electrolysis pot, and in maintaining said hole constantly open, preferably by the automatic actuation at short time intervals of a crust breaker of the point-type, in sucking the electrolysis gases through said hole from the chamber substantially bounded by the surface of the molten electrolysis bath and by the inner vault of the solidified crust, by applying a suction only to the area of crust which surrounds said hole and said crust breaker, in bringing said intaken gases, immediately at the outlet from said hole, in intimate contact with the alumina which has to be fed to the pot, so that said entrained products may react and/or may be anyway retained by said alumina, and in reintroducing said products so fixed or retained on alumina, as well as other substances and various constituents of the bath, directly into the same pot they had been emitted from.

More particularly, said crust area, which surrounds said hole and said crust breaker, and to which the suction is applied, is such that the amount of heat emitted by it, as referred to the amount of aluminum produced, involves a flow rate of fumes to be removed, it too referred to the amount of aluminum produced, which is of 8–20 $Nm^3$ per kg of produced aluminum. It has been seen indeed that with such a suction volume, which is only 10–15 times as large as the volume of $CO_2$ actually evolving from the electrolysis bath, and is 1/10 of the gas volume to be intaken according to the solution of the prior art, when said suction is localized in correspondence of said hole provided in the crust, from the pot surface no leaks occur of fumes and/or entrained substances both when on the surface of solidified crust other openings are provided and/or caused, such as, e.g., when alumina is fed by beaters of comb, rake or point type, or also of traditional type by independent devices external to the pot; or when the crust is perforated for tapping the metal, or when the consumed electrodes are replaced, in the case of prebaked-anodes pots.

Always according to the present invention, the intaken fumes, which contain a global amount of entrained substances varying from 50 to 150 g per kg of aluminum produced, are treated with alumina, in an amount corresponding at most to the amount to be fed to the same electrolysis pot, inside a reactor installed near the same pot, so that the temperature of the fumes entering said reactor is as high as possible, preferably higher than 150° C., so that hydrogen fluoride can all be fixed on the alumina by a stable bond, and furthermore the results are evenly distributed.

Once purification has been carried out, the basically $CO_2$ and air comprising gases are discharged to the outside of the system, to the atmosphere, and the alumina containing the fluorinated products and the other constituents of the bath which had been dragged by the fumes, preheated by said fumes, is fed back to the pot. Thus to the same pot the same constituents, are recycled as for quality and quantity, which had been withdrawn from it by evaporation and dragging. Thus the composition of the molten bath being maintained practically constant and unchanged over time, with evident advantages from the technical viewpoint, and as for the management of the electrolysis process.

The advantages resulting from the possibility of directly recycling into the same pot practically all of the constituents which have been subtracted to it by the fumes, without intermediate storages and redistributions, are even greater when to the molten bath of a pot special additives are added, such as, e.g., LiF and the like so that the composition of this bath is different from that inside the other pots of the plant, and therefore collecting the emissions from all the pots and then redistributing them in a general way would be impossible.

Always according to the present invention, equipment particularly suitable to accomplish said process for purifying the electrolysis fumes and recycling directly into the pot the recovered substances, is constituted:

by a cap or cover having the shape of an upside-down funnel or the like, made from a suitable material, preferably steel, placed in contact with the solidified crust of the pot in correspondence of, and covering both said hole for the electrolysis fumes suction, provided in the pot crust, and said known crust-breaking device of point-type; said cap or cover being directly connected, via pipe, to the equipment wherein the processing and purification of said fumes occurs, and to the suction devices;

by a fluidized-bed reactor of known type, preferably of the expanded-bed with conveyance type or of the injection type in "Venturi" type tube, suitable to allow said fumes to be treated by the alumina to be fed, comprising a filter able to retain alumina and the other solid particles dragged by the fumes, from which reactor said alumina, pre-heated and containing the recovered products, is directly fed into the electrolysis pot;

by a fan, it too of known type, preferably installed at the outlet of said reactor, said fan being suitable to yield such a gas flow rate to remove, through said gas, the amount of heat emitted by the surface of crust covered by said cap or cover.

More particularly, the surface area of crust covered by the cap is preferably comprised within the range of from 0.1 to 1 $m^2$, and the flow rate of intaken fumes is preferably comprised, as already said, between 8 and 20 $Nm^3$, as referred to 1 kg of produced aluminum.

BRIEF DESCRIPTION OF THE DRAWINGS

The invention, as regards a preferred and not exclusive form of practical embodiment, is described in the following with reference to the attached drawing tables, supplied for purely indicative and not limitative purposes, wherein.

DETAILED DESCRIPTION OF THE DRAWINGS

Figure 1:
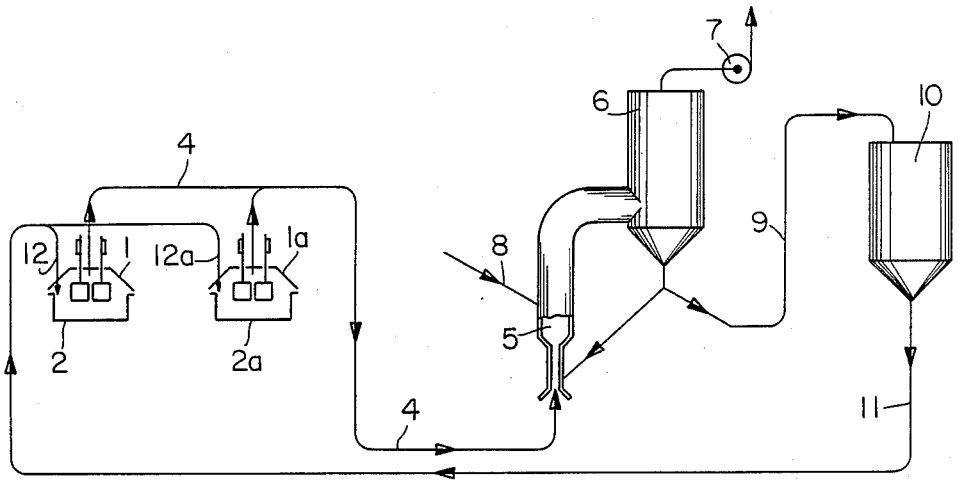
FIG. 1 PRIOR ART
FIG. 1 shows a schematic view of an installation for purifying over alumina the fumes of electrolysis pots, accomplished according to the known art, by a traditional technique.
Figure 2:
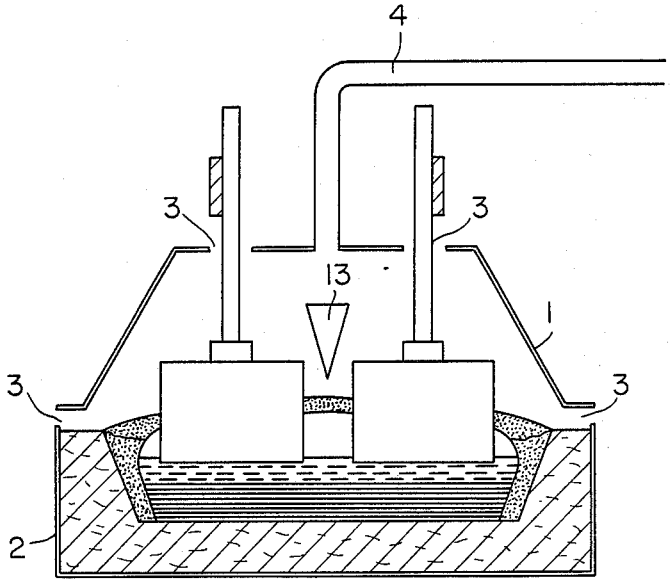
FIG. 2 PRIOR ART
FIG. 2 shows a type of hood closure of a pot according to the prior art.

Referring to FIGS. 1 and 2, provided only for comparative purposes, the electrolysis fumes are intaken from the top of hoods, 1*a*, . . . etc., which completely close the free surface of pots 2, 2*a*, . . . etc., together with air entering from the gaps 3, normally present and are conveyed, via manifold 4, to the fluidized-bed centralized reactor 5, to which all the fumes drawn from at least ten to twenty pots join, and wherein said fumes are purified from the fluorinated products and the other polluting substances, which are retained with the alumina. The purified gases pass through a hose filter 6 and are discharged to the atmosphere via the exhauster 7.

The alumina introduced into the reactor through duct 8, carries out the gas purification, and is then discharged through the pipe 9 and collected and stored in silo 10. From this latter, through duct 11, treated alumina is distributed among the pots, into which it is fed through 12, 12*a*, . . . and so forth.

In FIG. 2, schematically shown is also a type of traditional "wedge-shaped" central beater 13.

Figure 3:
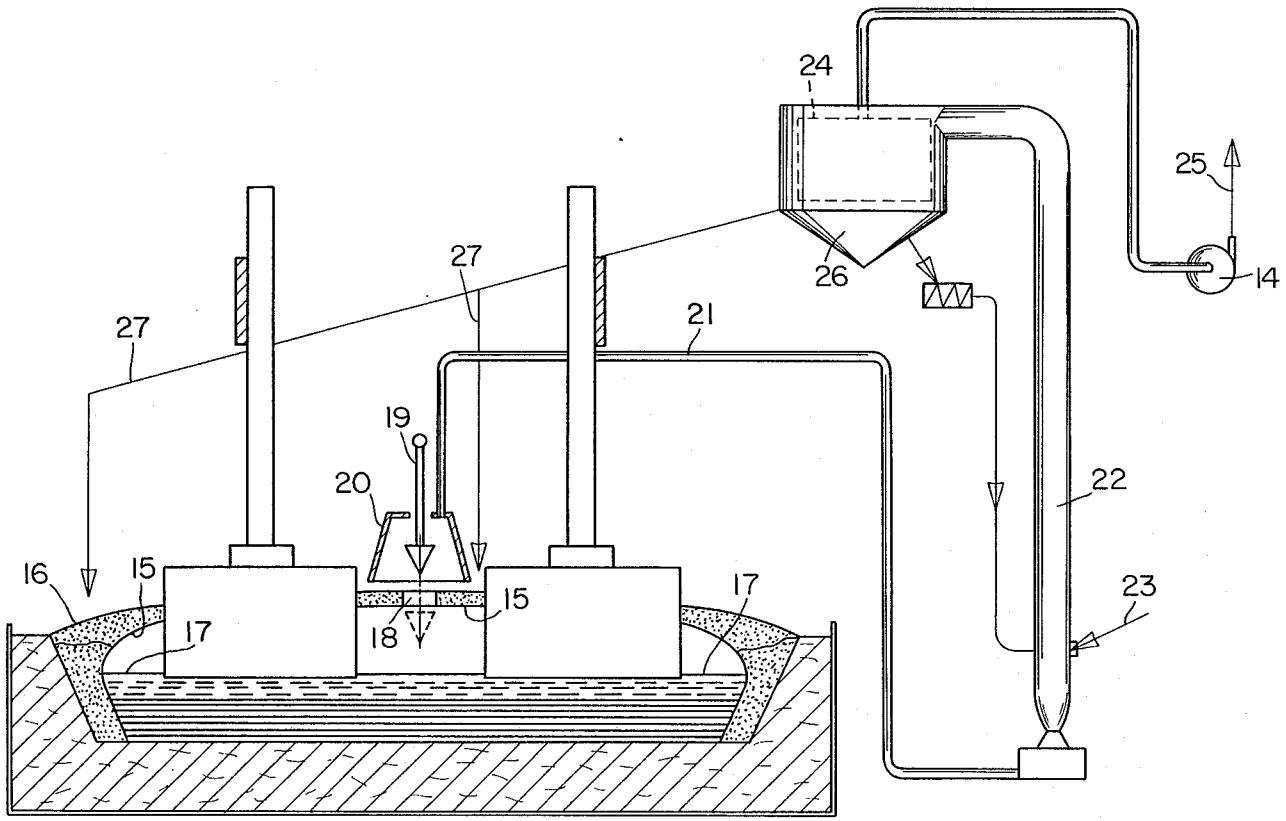
FIG. 3 shows a schematic view of a type of equipment, accomplished according to the invention, for the suction and purification of the electrolysis fumes, and the recycle of alumina into the pot.

Referring to FIG. 3, according to the present invention, the electrolysis fumes are sucked, by the fan 14 which creates intake in the whole equipment, from the chamber defined by the inner vault 15 of crust 16 and the liquid surface of molten bath 17, through the hole 18, provided in the crust, and kept always open by the point crust breaker 19, of known type, automatically actuated according to programmed times by per se known systems and devices not shown in figure. From cap or cover 20, the electrolysis gases, together with air penetrating through the gaps around the crust breaker and between the edge of the rim and the crust surface, are conveyed by the duct 21 to reactor 22, wherein the dragged substances are fixed and retained by alumina. The reactor 22 can be constituted by any device of known type, suitable to place and keep alumina in intimate contact with the fumes, and is preferably an expanded fluidized bed reactor with conveyance, or an injection "Venturi" type reactor.

Fresh alumina is introduced into reactor from 23 and the purified gases, after passing through the filter 24, are discharged to the atmosphere from 25. Reacted alumina is collected in 26 and from here, through ducts 27, is fed to the pot, it being introduced into the molten bath by the traditional devices for crust breaking, preferably of the perforator point type, not shown in figure.

From what has been hereinabove exposed, and from what results from the attached drawings, further considerable advantages become evident, besides those hereinabove mentioned, above all as regards the operating practice and the consequent financial and qualitative outcomes. Such advantages can be summarized as follows:

Fumes purification devices distributed pot by pot, with very very low dimensions and low cost.

Absence of ducts and pipings for the conveyance through the potroom of the fumes to be purified, such ducts and pipings always representing a considerable hindrance and causing difficulties in the operation of the plant, besides having a high cost;

Uniform distribution of hydrogen fluoride fixed on the particles of alumina and accomplishment of a stable bond, thanks to the high temperature at which the contact between the same acid and alumina occurs;

Possibility of easily and repeatedly varying the flow rate of fumes intake, as a function of pot operating conditions, to accomplish an optimum sequestering, thanks to the extremely reduced dimensions of the fumes processing equipment and to their distribution pot by pot;

Possibility of recycling to each individual pot the substances removed from it by evaporation and dragging, and hence higher flexibility and reliability in plant management;

Possibility of installing the purification equipment in already existing plants, without the necessity of stopping plant operation, with consequent loss of production and damage to the plant.

Obviously, in the practical embodiment, to the invention as above described according to a preferred and not exclusive form thereof, structurally and functionally equivalent modifications and variants can be supplied, without departing from the protective scope of the same invention.

I claim:

1. A process for purifying the fumes emitted by electrolysis pots for the production of aluminum from fluorinated products and other constituents of the bath by means of alumina in dry-scrubbing apparatus and for recovering and using again said products, said alumina and said constituents in said pots, which comprises:

(a) providing a fused salt electrolytic cell having a molten electrolyte therein and a crust on top of the molten electrolyte;

(b) providing at least one hole in the crust of said pot constituted by solidified electrolysis bath by means of a crust breaker of the point-breaking type;

(c) maintaining said hole constantly open by the automatic actuation at short time intervals of said crust breaker;

(d) sucking said electrolysis fumes through said hole from the chamber defined by the surface of the molten electrolysis bath and by the inner vault of the solidified crust, the suction being applied to only the area of the outer surface of the crust by means of a cap or cover immediately surrounding said hole and said crust breaker, said area ranging from 0, 1 to 1 $m^2$;

(e) bringing said intaken fumes, immediately at the outlet from said cap or cover, into a dry-scrubbing apparatus positioned adjacent to said pot and into intimate contact with the fresh alumina which is to be fed to the pot so that said vapors, and/or solid and/or liquid particles dragged in the fumes react and/or are retained by said fresh alumina; and (f) introducing the products as well as the substances fixed and/or reained on said fresh alumina and/or originated by any reaction of said vapors and/or particles dragged in the fumes with said fresh alumina, directly and solely into the same pot they had been emitted from, carried and supported by said fresh alumina.

2. A process according to claim 1, wherein said area of the crust to which said suction is applied, is such that the amount of heat emitted by it involves a flow rate of gas to be removed comprised of from 5 $m^3$ to 20 $m^3$, referred to 25° C. and 750 mmHg, per Kg of aluminum produced.

3. An apparatus for purifying the fumes emitted by an electrolysis pot for the production of aluminum from fluorinated products and other constituents of the bath by means of a dry-scrubbing system on alumina and for recovering and using again said products, said alumina and said constituents in said pot, which comprises:

(a) a fused salt electrolytic cell having a molten electrolyte therein and a crust on top of the molten electrolyte;

(b) a crust breaker of the point-breaking type automatically actuated at short time intervals for providing a hole in the crust of said pot, constituted by solidified electrolysis bath, and maintaining said hole constantly open;

(c) a cap or cover having shape and size to contain said crust breaker and to just cover the area of the outer surface of the crust immediately surrounding said crust breaker and said hole, said area comprising from 0.1 $m^2$ to 1.0 $m^2$, for te electrolysis fumes suction;

(d) a dry-scrubbing reactor positioned adjacent to said pot and connected via pipe to said cap or cover, said reactor being suitable to allow said electrolysis fumes to be treated by the fresh alumina to be fed to said pot and comprising a filter of known type able to retain the alumina and the other solid particles dragged by the fumes, from which reactor said alumina, pre-heated by said fumes and containg the recovered products, is directly fed only into the same pot from which they had been emitted; and (e) a suction device installed at the outlet of said dry-scrubbing reactor, said suction device being suitable to yield such a gas flow rate as to remove, through said fumes, the amount of heat emitted by said area of the outer surface of the crust covered by said cap or cover.

4. An apparatus according to claim 3, wherein the dry scrubbing reactor is a reactor of the group comprising the expanded-bed with conveyance type and injection "Venturi" type reactors.

5. An apparatus according to claim 3, wherein said gas flow rate to remove through said fumes the amount of heat emitted by said area of the crust covered by said cap is comprised from 5 $m^3$ to 20 $m^3$, referred to 25° C. and 760 mmHg, per Kg of aluminum produced.

6. An apparatus according to claim 3 which is individually associated to each individual electrolysis pot.

* * * * *